US006586878B1

(12) United States Patent
Tu

(10) Patent No.: US 6,586,878 B1
(45) Date of Patent: Jul. 1, 2003

(54) METAL HALIDE LAMP WITH IMPROVED GETTER ORIENTATION

(75) Inventor: Jun Ming Tu, Bath, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/464,865

(22) Filed: Dec. 16, 1999

(51) Int. Cl.[7] ..... H01J 17/24; H01J 61/26
(52) U.S. Cl. ..... 313/549; 313/553; 313/554
(58) Field of Search ..... 313/25, 553, 554, 313/558, 559, 549

(56) References Cited

U.S. PATENT DOCUMENTS 3,626,229 A * 12/1971 Spacil et al. ..... 313/25
4,281,267 A * 7/1981 Johnson ..... 313/25
4,709,184 A * 11/1987 Keefe et al. ..... 313/638
5,130,047 A * 7/1992 Nagel ..... 252/181.6
5,159,229 A * 10/1992 Passmore et al. ..... 313/25
5,610,469 A * 3/1997 Bergman et al.
5,708,328 A * 1/1998 Matthews et al. ..... 313/573

FOREIGN PATENT DOCUMENTS

EP 497225 8/1992 ..... H01J/61/26
GB 1333272 10/1973 ..... H01J/61/26

* cited by examiner

*Primary Examiner*—Ashok Patel
*Assistant Examiner*—Glenn Zimmerman
(74) *Attorney, Agent, or Firm*—Frank Keegan

(57) ABSTRACT

A metal halide discharge lamp has an ellipsoidal outer envelope with a quartz glass arc tube on its major axis supported by a frame having metal straps engaging pinched ends of the arc tube, which lie in a common pinch plane. An inert gas fill between the arc tube and the envelope establishes convection flow patterns during operation. Getters in the form of strips of ZrAl alloy are welded to the straps at 45° to the pinch plane on opposite sides thereof. The getter orientation improves absorption of impurities during horizontal lamp orientation, so that hydrogen spikes and other problems are eliminated.

20 Claims, 4 Drawing Sheets

HYDROGEN SPIKES IN BASE-UP (BU),BASE-DOWN (BD), AND HOR ORIENTATIONS.

DROPBACK VOLTAGE IN BASE-UP (BU), BASE-DOWN (BD), AND HOR ORIENTATIONS.

HYDROGEN SPIKES IN HORIZONTAL OPERATION LAMPS WITH GETTER ANGLES OF LESS THAN 15 DEGREE AND 45 DEGREE.

DROPBACK VOLTAGE IN HORZONTAL OPERATION LAMPS WITH GETTER ANGLES OF LESS THAN 15 DEGREE AND AT 45 DEGREE.

METAL HALIDE LAMP WITH IMPROVED GETTER ORIENTATION

BACKGROUND OF THE INVENTION

The invention relates to a discharge lamp of the type having a base, an outer envelope, an arc tube with a pair of opposed pinches and a metal halide filling, a space between the arc tube and the envelope, a frame supporting the arc tube with straps around the pinches, and a getter strip fixed relative to at least one of the straps.

The function of the getter strip is to absorb impurities in the inert gas or nitrogen which fills the space between the arc tube and the outer envelope. Zirconium alloys such as ST-101 (Zr84Al16) are widely used in metal halide lamps as a getter to absorb impurities such as hydrogen, water vapor, and hydrocarbons. These impurities are detrimental to lamp performance. For example hydrogen can diffuse through the quartz envelope of an arc tube and form hydrogen iodide, which causes voltage spikes as the lamp warms up, thereby causing the dropback or RMS voltage to increase. In the worst case, excessive hydrogen iodide in the system would cause the lamp to extinguish.

The best results are achieved when the getter temperature is within an optimal range, which dictates that the getter be mounted next to the arc tube. The ST-101 getter in high wattage metal halide lamps is typically welded to the arc tube straps at an angle of less than 15°, for example 5° or even parallel to the strap.

However the inventor has discovered that this orientation renders the getter somewhat non-functional when the lamp is operated horizontally.

FIGS. 1 and 2 show the convection flow patterns in a metal halide lamp having an ellipsoidal outer envelope with an arc tube mounted on its major axis. As shown in FIG. 1, convection flows are generated in the lamp during vertical operation as shown by the ovals. The inert gas in the space between the arc tube and the outer envelope flows upward adjacent to the hot surface of the arc tube, then back down toward the base adjacent to the cooler surface of the envelope. During horizontal operation, as shown in FIG. 2, convection flows are generated as indicated by the modified ovals. The inert gas flows upward around the circumference of the arc tube, then back down around the ends of the arc tube and the cooler surfaces of the outer envelope. Flows from opposite ends converge at the minor axis of the ellipsoid.

During vertical operation, as shown in FIG. 1, the getter is positioned transverse to the flow and therefore is well positioned to absorb impurities as they flow by. However during horizontal operation, as shown in FIG. 2, the getter may not be properly exposed to the flow and therefore may not absorb impurities efficiently. This can result in poor performance over life such as voltage rise and poor lumen maintenance. The lamps may even cycle on and off.

FIGS. 3 and 4 show experimental data for a metal halide type MH 1000/U lamp having getters oriented at less than 15°, actually about 5°, with respect to the strap. FIG. 3 shows voltage spikes due to the presence of hydrogen in the arc tube (hydrogen spikes) during continuous operation with the lamp in three operating positions, which are base-up, base-down, and horizontal. With the lamp operated horizontally, the spikes reach a maximum of 250 volts at 275 hours. In both vertical positions the spikes are negligible. FIG. 4 shows the voltage from the time of an arc until it drops back (dropback voltage). This rises steadily to a maximum of 45 volts at 275 hours in horizontal operation, but stabilizes at about 23 volts during vertical operation.

U.S. application Ser. No. 09/176,550 discloses a metal halide lamp of the type to which the invention relates, having an ellipsoidal outer envelope and ST 101 getters welded to the pinch straps at an angle of about 15° to the plane of the pinch straps.

EP 0497225 discloses a high pressure sodium lamp having a BaAl ring arranged in a vacuum space between the ceramic arc tube and the outer envelope, at an angle between 30 and 45° to the geometric axis of the lamp. During manufacture of the lamp, the ring is heated by induction heating so that barium evaporates and deposits layers on the stem and on the inside surface of the envelope. During operation of the lamp, the layer on the stem reaches temperatures of 350–420° C., which is suitable for binding oxygen in the space. The layer on the envelope reaches temperatures of 120–250° C., which is suitable for absorbing hydrogen. The ring itself has no function during operation. There are virtually no convection currents in the space because there is no fill gas; the oxygen and hydrogen are only contaminants in a vacuum space.

GB 1,333,272 discloses a ZrAl getter ring mounted in the end of a 400 watt T-bulb type lamp remote from the arc tube. No hydrogen gettering problems have been observed in lamps of this type.

JP 57-84557 discloses a high pressure sodium lamp having zirconium getters mounted to the support frame for the ceramic arc tube, and a rare gas such as xenon in the space. The arc tube is cylindrical because ceramic cannot be formed with pinches, and there is no indication that the getter strips are mounted at any particular orientation.

SUMMARY OF THE INVENTION

It is an object of the present invention to provide a metal halide discharge lamp with good gettering of hydrogen and other impurities in the space between the arc tube and the outer envelope, regardless of operating position of the lamp.

According to the invention, a getter strip is fixed adjacent to one of the pinches closing the arc tube, at an angle of at least 30° to the pinch plane. When the lamp is operated in a horizontal position, the getter strip is thus positioned transversely to convection flow around the pinch, regardless of angular orientation.

Preferably, getter strips are fixed adjacent to both pinches on opposite sides of the pinch plane, at angles of at least 30° to the pinch plane.

Preferably, the getter strips are a zirconium aluminum alloy, in particular ST 101, and are welded directly to the straps which hold the pinches of the arc tube. With the strips extending from the straps at 45° in a 1000 watt lamp having an ellipsoidal envelope and a nitrogen fill in the space, hydrogen spikes were, virtually eliminated when the lamp was operated in a horizontal position, and dropback voltage values were comparable to those in other operating positions.

The test results are interpreted to mean that the orientation of the getter strip at angles over 30° to the pinch plane results in better absorption of impurities than orientation at more acute angles.

DETAILED DESCRIPTION OF THE PREFERRED EMBODIMENTS

Figure 1:
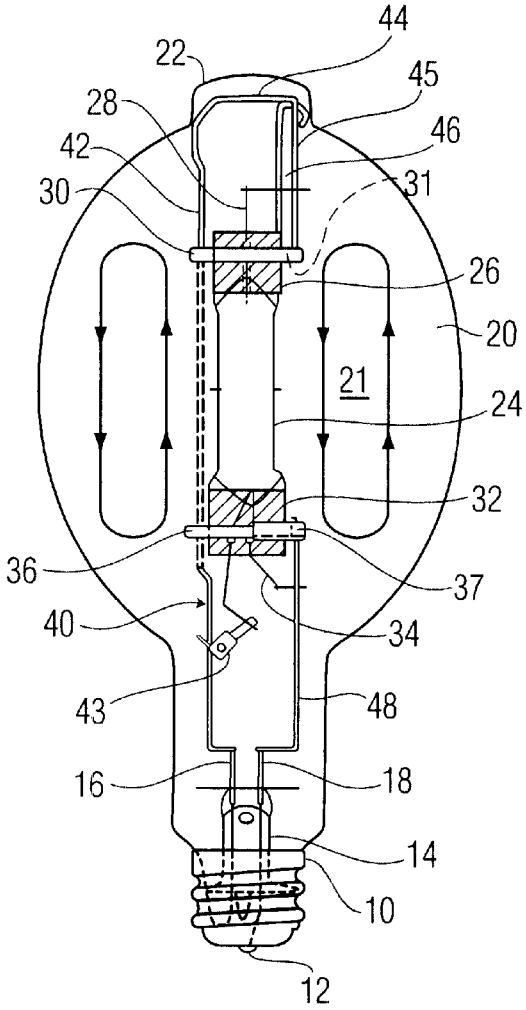
FIG. 1 shows the convection flow in a vertically operated elliptical discharge lamp.
Figure 2:
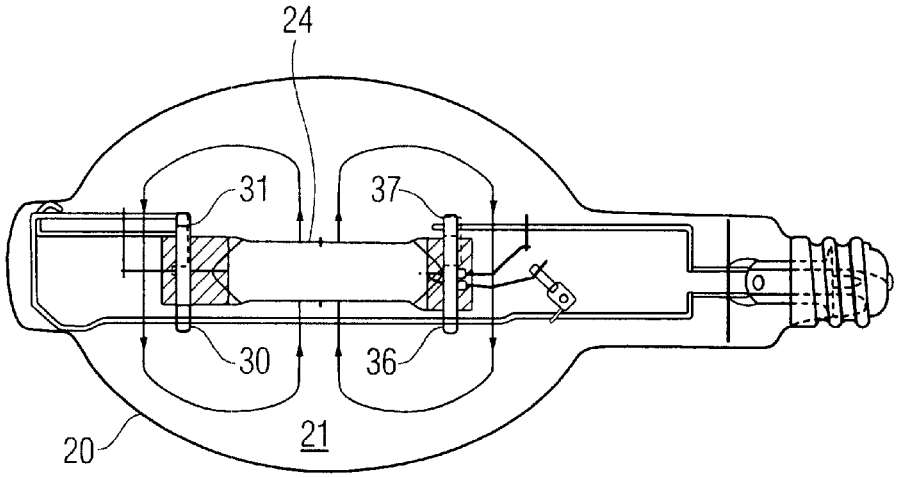
FIG. 2 shows the convection flow in a horizontally operated elliptical discharge lamp.

Referring to FIGS. 1 and 2, the discharge lamp according to the invention has a base 10 with an insulated center contact 12, a glass stem 14, and leads 16, 18 embedded in the stem and connected to base 10 and contact 12 respectively. A glass envelope 20 sealed to the stem 14 has a generally ellipsoidal shape and a closed end 22 with a cylindrical inside surface. The lamp is an MH type lamp manufactured by Philips Lighting Company in 1000 and 1500 watt sizes The lamp has an arc tube 24 with a first pinch 26 sealing a first lead-through for first electrode 28, and a second pinch 32 sealing a second lead-through for second electrode 34. The pinches 26, 28 are formed on the ends of a quartz tube while it is still soft, and are coplanar, being formed in a common pinch plane. A first wire frame member 40 carries a first support strap 30 which is fixed about the first pinch 26, and a second wire frame member 48 carries one end of second support strap 36 which is fixed about second pinch 32, while first member 40 carries the other end. The first and second electrodes 28, 34 are aligned along a central axis of the outer envelope 20, which corresponds to the major axis of the ellipsoid.

The first frame member 40 is formed with a first upright 42, an apex 44, a downward extending leg 45, and a spring arm 46. A starter 43 assists starting by causing a glow discharge at the second electrode 34. Further details of the support and current carrying structure are described in U.S. application Ser. No. 09/176,550, which is incorporated herein by reference.

Figure 3:
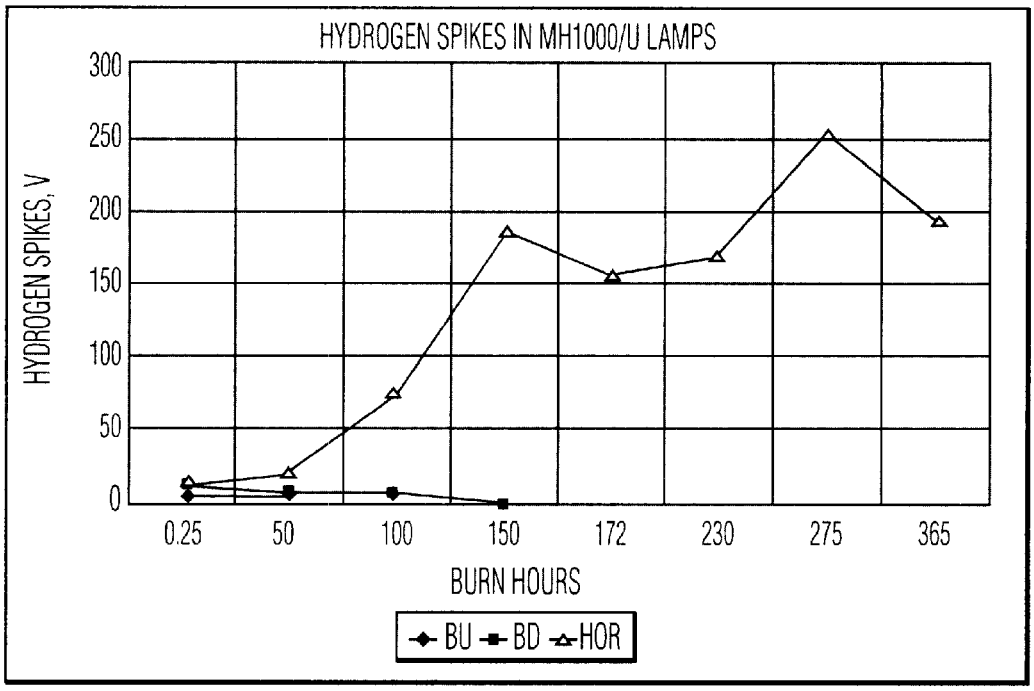
FIG. 3 PRIOR ART
FIG. 3 is a plot of hydrogen spikes vs. time for vertical and horizontal operation of a 1000 watt metal halide lamp with a conventionally mounted getter.
Figure 4:
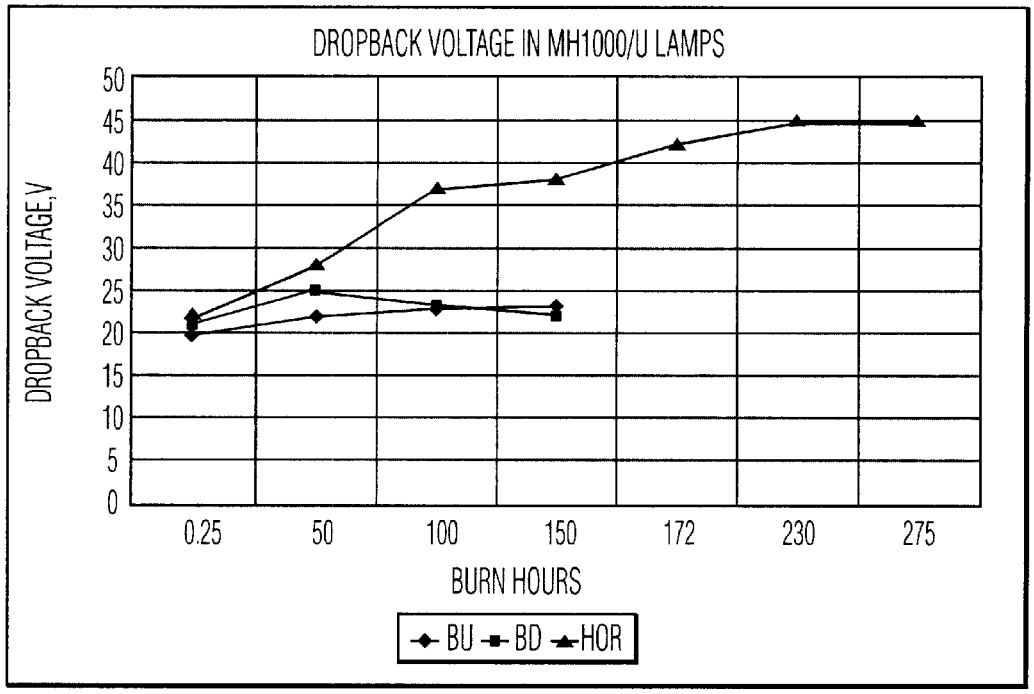
FIG. 4 PRIOR ART
FIG. 4 is a plot of dropback voltage versus time for vertical and horizontal operation of a 1000 watt metal halide lamp with a conventionally mounted getter.
Figure 5:
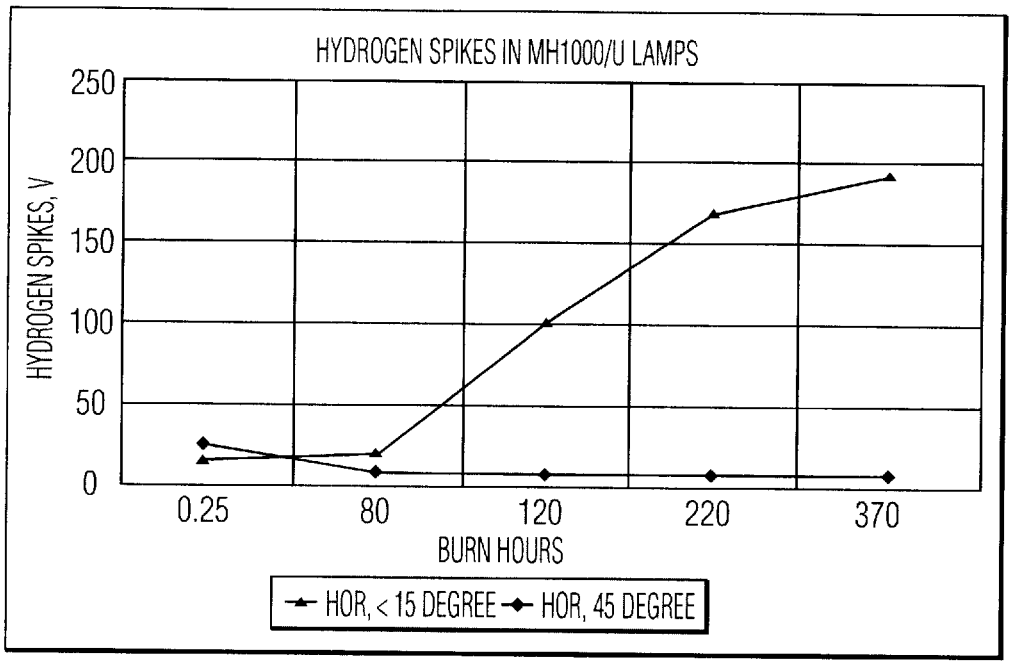
FIG. 5 is a plot of reignition voltage vs. time for horizontal operation with a getter mounted at 5° and with a getter mounted at 45°.
Figure 6:
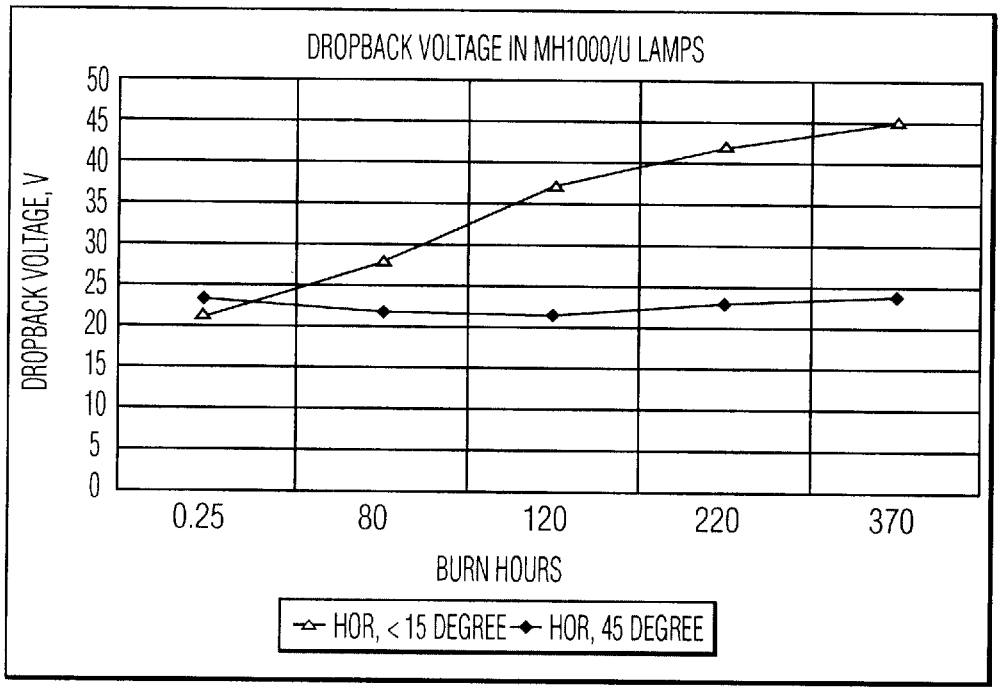
FIG. 6 is a plot of dropback voltage vs. time for horizontal operation with a getter mounted at 5° and with a getter mounted at 45°.
Figure 7:
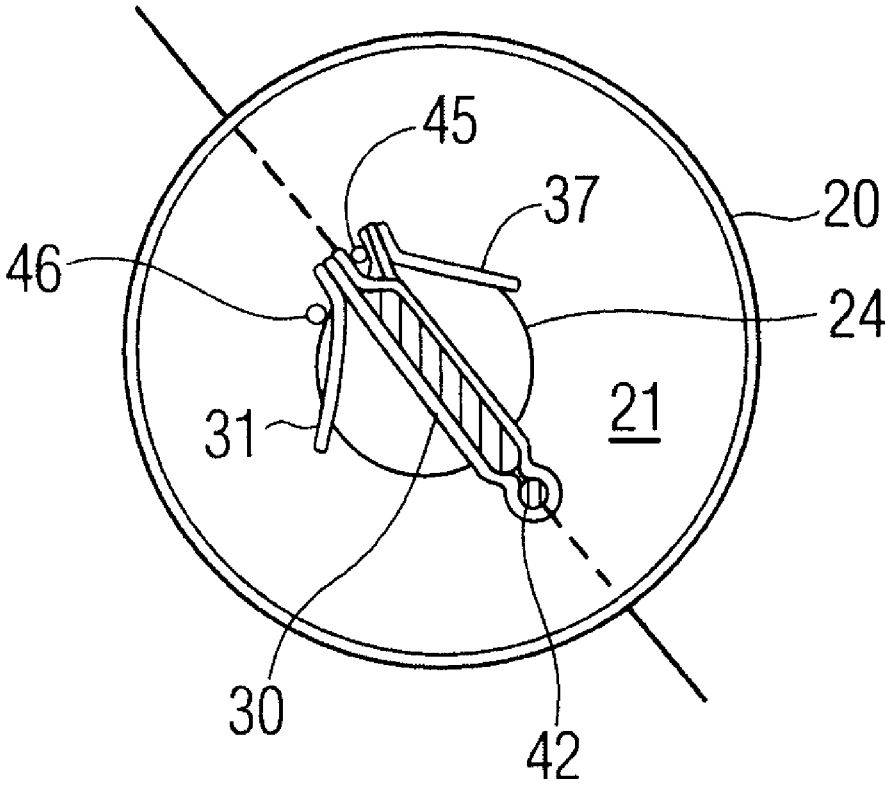
FIG. 7 is an end cross-section of an ellipsoidal lamp with getters mounted according to the invention.

As can also be seen in FIG. 7, getters in the form of metal strips 31, 37 are welded to each of the pinch straps 30, 36 on opposite sides of the pinch plane. The getters are a zirconium alloy, preferably ST 101, which is suitable for absorbing impurities such as hydrogen and water vapor in the inert gas atmosphere circulating in space 21 between the arc tube 24 and outer envelope 20. The getters 31, 37 according to the invention are welded to the pinch straps at an angel in the range of 30° to 60°, preferably 45°, to the pinch plane. With an ST 101 getter mounted at 45° to the pinch plane in a horizontally operated lamp, the hydrogen spikes and drop back voltages associated with the prior art orientation of 5°, virtually disappear. This is depicted graphically in FIGS. 5 and 6, where additional control tests for horizontal operation with a 5° getter angle (indicated by triangles) have been performed. For horizontal operation with a 45° getter angle (indicated by diamonds) voltage characteristics are substantially uniform and conform to those for vertical operation, as shown in FIGS. 3 and 4.

The foregoing is exemplary and not intended to limit the scope of the claims which follow.

What is claimed is:

1. Discharge lamp comprising:

a base, an outer envelope fixed to said base, said outer envelope having a closed end remote from said base and a central axis extending between said base and said closed end, an arc tube mounted on said central axis, said arc tube having a quartz envelope sealed by a pair of opposed pinches defining a pinch plane, and a metal halide filling, a space between said arc tube and said outer envelope, said space having an inert gas filling, a support frame fixing said arc tube on said central axis, said support frame comprising a pair of pinch straps fixed around respective pinches, and at least one getter strip fixed relative to said frame adjacent to a respective at least one of said pinches, each said getter strip having a top and a bottom flat surface and two side edges, with substantially all of the top and bottom flat surfaces defining a second plane and said second plane extending at an acute angle of at least 30° to said pinch plane.

2. A discharge lamp as in claim 1 comprising a pair of said getter strips adjacent to respective said pinches.

3. A discharge lamp as in claim 1 wherein said getter strips extend from opposite sides of said pinch plane, whereby said getter strips lie in planes intersecting said central axis at an acute angle of at least 60° to each other.

4. A discharge lamp as in claim 1 wherein said outer envelope is substantially ellipsoidal, the central axis corresponding to the major axis of the ellipsoid.

5. A discharge lamp as in claim 1 wherein said getter strip comprises a zirconium-aluminum alloy.

6. A discharge lamp as in claim 5 wherein said getter strip consists of a zirconium-aluminum alloy.

7. A discharge lamp as in claim 6 wherein said zirconium-aluminum alloy contains 84% zirconium and 16% aluminum.

8. A discharge lamp as in claim 5 wherein said getter strip is positioned so that it attains a temperature of 300 to 350° Centigrade during operation of said lamp.

9. A discharge lamp as in claim 1 wherein the getter strip is fixed to the frame adjacent to at least one of the straps.

10. A discharge lamp as in claim 1 wherein, said at least one getter strip is welded to at least one of the straps.

11. A discharge lamp comprising:

a gas tight outer envelope enclosing a space, an arc tube within the outer envelope, the arc tube and the outer envelope having a common central axis, the arc tube being provided with a gastight quartz envelope with a metal halide filling, the space between the arc tube and the outer envelope, having an inert gas filling, flattened end portions of the arc tube defining a plane in which the central axis lies, and at least one getter strip having a top and a bottom flat surface and two side edges, with substantially all of the top and bottom flat surfaces extending at an acute angle of at least 30° to said plane and positioned transversely to convection flow around one of said end portions of the arc tube when the lamp is in a horizontal position.

12. A discharge lamp as in claim 11 comprising a pair of said getter strips adjacent to respective said end portions.

13. A discharge lamp as in claim 11 wherein a second getter strip is positioned transversely to the convection flow around another of said end portions and extends from the side of said plane opposite said at least one getter strip, whereby the sum of said angle of at least 30° and an acute angle between the second getter strip and said plane is at least 60°.

14. A discharge lamp as in claim 11, wherein said outer envelope is substantially ellipsoidal, the central axis corresponding to the major axis of the ellipsoid.

15. A discharge lamp as in claim 11 wherein said getter strip comprises a zirconium-aluminum alloy.

16. A discharge lamp as in claim 11 wherein said getter strip consists of a zirconium-aluminum alloy.

17. A discharge lamp as in claim 16 wherein said zirconium-aluminum alloy contains 84% zirconium and 16% aluminum.

18. A discharge lamp as in claim 11 wherein said getter strip is positioned so that it attains a temperature of 300 to 400° Centigrade during operation of said lamp.

19. A discharge lamp as in claim 11 wherein the getter strip is fixed to a support frame fixing said arc tube on said central axis, said support frame comprising a pair of straps fixed around respective said end portions, the getter strip being adjacent to at least one of the straps.

20. A lamp comprising:

an outer envelope;

an arc tube within said outer envelope, said arc tube having flattened end portions that define a first plane;

a frame that supports said arc tube; and at least one getter strip attached to said frame, said at least one getter strip having a top and a bottom flat surface and two side edges, with substantially all of the top and bottom flat surfaces being in a single plane and extending at an acute angle of at least 30° to said first plane.

* * * * *